US008000637B2

(12) United States Patent
Izumi et al.

(10) Patent No.: US 8,000,637 B2
(45) Date of Patent: Aug. 16, 2011

(54) SUPPLYING AND DISCHARGING DEVELOPER IN AN IMAGE FORMING APPARATUS, PROCESS CARTRIDGE AND DEVELOPING DEVICE

(75) Inventors: Takao Izumi, Kanagawa-ken (JP); Hiroshi Murata, Kanagawa-ken (JP); Takashi Hatakeyama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 15 days.

(21) Appl. No.: 12/418,720

(22) Filed: Apr. 6, 2009

(65) Prior Publication Data

US 2009/0257784 A1 Oct. 15, 2009

(30) Foreign Application Priority Data

Apr. 11, 2008 (JP) ..... 2008-103168

(51) Int. Cl.
*G03G 15/08* (2006.01)

(52) U.S. Cl. ..... 399/258; 399/262

(58) Field of Classification Search ..... 399/120, 399/257, 258, 264, 275, 276
See application file for complete search history.

(56) References Cited

U.S. PATENT DOCUMENTS 6,920,301 B2 * 7/2005 Arimoto ..... 399/227

FOREIGN PATENT DOCUMENTS

JP 10-090991 4/1998

* cited by examiner

*Primary Examiner* — Hoang Ngo
(74) *Attorney, Agent, or Firm* — Turocy & Watson, LLP

(57) ABSTRACT

An image forming apparatus includes a charger to charge an image carrying member, an optical device to irradiate a light onto the image carrying member to form an electrostatic latent image, a developing device to develop the electrostatic latent image on the image carrying member to form a developed image and a transfer device to transfer the developed image on a sheet. The developing device includes a developer container to store a developer including toner and a carrier, a developer supply device to supply the developer to the developer container, a driver device to drive the developer supply device, a developer collection device installed in the developer container to interlock with the driver device and collect a surplus developer left over due to supply of the developer from the developer supply device to the developer container, and a collected developer container to contain the developer collected by the developer collection device.

20 Claims, 11 Drawing Sheets

SUPPLYING AND DISCHARGING DEVELOPER IN AN IMAGE FORMING APPARATUS, PROCESS CARTRIDGE AND DEVELOPING DEVICE

CROSS-REFERENCE TO RELATED APPLICATION

This application is based upon and claims the benefit of priority from the prior Japanese Patent Application No. 2008, 103168, filed on Apr. 11, 2008; the entire contents of all of which are incorporated herein by reference.

FIELD OF THE INVENTION

The present invention relates to an image forming apparatus, a process cartridge and a developing device, and more particularly to an image forming apparatus, in a developing device of a system of supplying a developer to the developing device and furthermore discharging the developer in the developing device, for supplying and discharging the developer in link motion, a process cartridge and the developing device.

DESCRIPTION OF THE BACKGROUND

Conventionally, a developing device using a two-component developer composed of toner and a carrier is used. In such a developing device, the toner is consumed by the developing operation, though the carrier remains in the developing device without being consumed. The carrier stirred together with the toner in the developing device, as the stirring frequency increases, causes a situation that the resin coat layer on the surface is separated or the toner is adhered onto the surface, thereby causes deterioration. As a result, the charging characteristic of the developer is lowered slowly.

Therefore, there is a developing device available, separately from feed of toner consumed by development, for feeding a carrier little by little into the developing device, thereby suppressing a lowering of the charging characteristic.

This developing device permits the developer becoming excessive due to feed of a carrier to overflow and discharge from the developer discharging port for developer discharge installed at a predetermined position on the wall of the developer bath. By successive repetition of such feed and discharge, the deteriorated developer in the developing tank is replaced with toner and a carrier which are fed newly.

By doing this, the developer quantity in the developing tank is kept constant and the charging characteristic of the developer is maintained and the copied image quality is prevented from lowering, thus the image formation can be performed satisfactorily.

However, in this overflow system, the supply of the developer to the developing device and the discharge of the developer from the developing device are not interlocked with each other. Therefore, the quantity of the developer in the developing device depends on an environmental change. For example, when the developer is increased in quantity, the drive torque of the developing device becomes high and there are possibilities of damage of the gears of the developing device. When the developer is decreased in quantity, in correspondence to the conveying screw pitch of the developing device, image irregularities are caused easily.

To solve the aforementioned problems, in Japanese Patent Application Publication No. 10-90991, an art of detecting accurately the supply quantity and discharge quantity of a developer, controlling the developer supply and discharge highly precisely, thereby maintaining the developer quantity constant is disclosed.

In the apparatus disclosed in Japanese Patent Application Publication No. 10-90991, a problem arises that in order to detect accurately the toner feed quantity and toner discharge quantity, the toner consumption quantity detecting means and exhausting developer quantity detecting means are used, thus the necessary parts of the apparatus are increased in number and the structure is complicated in correspondence to it and the cost thereof is increased.

SUMMARY OF THE INVENTION

An object of the present invention is to provide an image forming apparatus capable of keeping the developer quantity constant in the developing device in an inexpensive mechanism, a process cartridge and the developing device.

An image forming apparatus is provided in an embodiment of the present invention and the image forming apparatus comprises a charger to charge an image carrying member; an optical device to irradiate a light onto the image carrying member to form an electrostatic latent image; a developing device to develop the electrostatic latent image on the image carrying member to form a developed image; and a transfer device to transfer the developed image on a sheet, wherein the developing device includes a developer container to store a developer including toner and a carrier; a developer supply device to supply the developer to the developer container; a driver device to drive the developer supply device; a developer collection device installed in the developer container to interlock with the driver device and collect a surplus developer left over due to supply of the developer from the developer supply device to the developer container; and a collected developer container to contain the developer collected by the developer collection device.

Further, a process cartridge is provided in an embodiment of the present invention and the process cartridge comprises an image carrying member whereon an electrostatic latent image is formed; a developer container to store a developer including toner and a carrier; a developer supply device to supply the developer to the developer container; a driver device to drive the developer supply device; a developer collection device installed in the developer container to interlock with the driver device and collect a surplus developer left over due to supply of the developer from the developer supply device to the developer container; and a collected developer container to contain the developer collected by the developer collection device.

Furthermore, a developing device is provided in an embodiment of the present invention and the developing device comprises a developer container to store a developer including toner and a carrier; a developer supply device to supply the developer to the developer container; a driver device to drive the developer supply device; a developer collection device installed in the developer container to interlock with the driver device and collect a surplus developer left over due to supply of the developer from the developer supply device to the developer container; and a collected developer container to contain the developer collected by the developer collection device.

DETAILED DESCRIPTION OF THE INVENTION

Hereinafter, the embodiment of the present invention will be explained with reference to the accompanying drawings.

Figure 3:
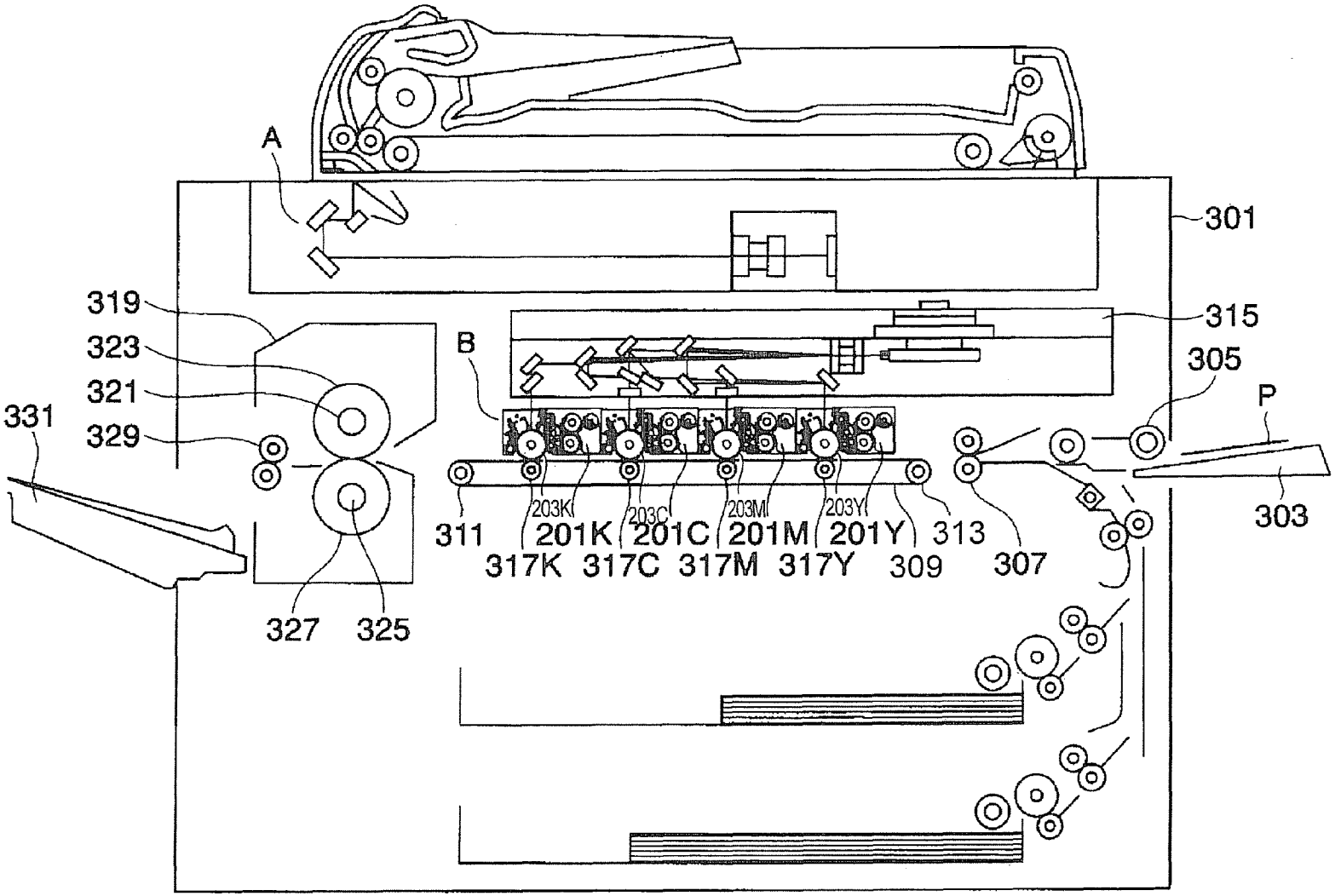
FIG. 3 is an internal block diagram showing the color image forming apparatus relating to the first embodiment of the present invention.

FIG. 3 shows schematically the internal constitution of the color image forming apparatus of a four-each tandem type. A color image forming apparatus 301 is equipped with a scanner portion A for exposing a document and an image forming portion B.

On one side of the color image forming apparatus 301, a paper feeding device 303 with sheets P stacked is installed and by a paper feeding roller 305 installed in the paper feeding device 303, the sheets P are fed one by one into the color image forming apparatus 301.

The sheets P fed from the paper feeding device 303 into the color image forming apparatus 301 are aligned by a pair of aligning rollers 307 and are conveyed onto a transfer belt 309.

The transfer belt 309, as a material which is stable thermally and in respect of wear resistance, is made of, for example, semi-conducting polyimide. The transfer belt 309 is stretched between a drive roller 311 and a driven roller 313. The driven roller 313 is given tension and the transfer belt moves free of sagging.

Above the transfer belt 309 (in the direction of the scanner portion A), process cartridges 201Y, 201M, 201C and 201K composing the image forming portion B are installed. The respective process cartridges 201Y, 201M, 201C and 201K include toner of yellow (Y), magenta (M), cyan (C) and black (K) colors.

The respective process cartridges 201Y, 201M, 201C and 201K include furthermore photoreceptor drums 203Y, 203M, 203C and 203K which are image carrying members. Around each of the process cartridges 201Y, 201M, 201C and 201K, in the rotational direction, a charger for charging uniformly the surface of each photoreceptor drum, a developing device for developing a latent image formed on each photoreceptor drum and a cleaning device for removing residual toner remaining on each photoreceptor drum after transfer are arranged.

The process cartridges 201Y, 201M, 201C and 201K are respectively converted to a cartridge and are installed removably on the color image forming apparatus 301.

Further, between the respective process cartridges 201Y, 201M, 201C and 201K and the scanner portion A, a laser beam optical device 315 is installed. A laser beam emitted from the laser beam optical device 315 is led to the photoreceptor drums 203Y, 203M, 203C and 203K.

Furthermore, inside the transfer belt 309, opposite to the photoreceptor drums 203Y, 203M, 203C and 203K, transfer devices 317Y, 317M, 317C and 317K are installed. On the conveyance end side of the transfer belt 309, a fixing device 319 is installed. The fixing device 319 is composed of a fixing roller 323 having a built-in fixing roller lamp 321 and a pressing roller 327 which has a built-in pressing roller lamp 325 and is arranged opposite to the fixing roller 323.

On the conveyance end side of the fixing device 319, a pair of discharge rollers 329 are arranged. By the discharge rollers 329, the sheets P are discharged to a receiving tray 331 attached to the side of the color image forming apparatus 301.

Figure 1:
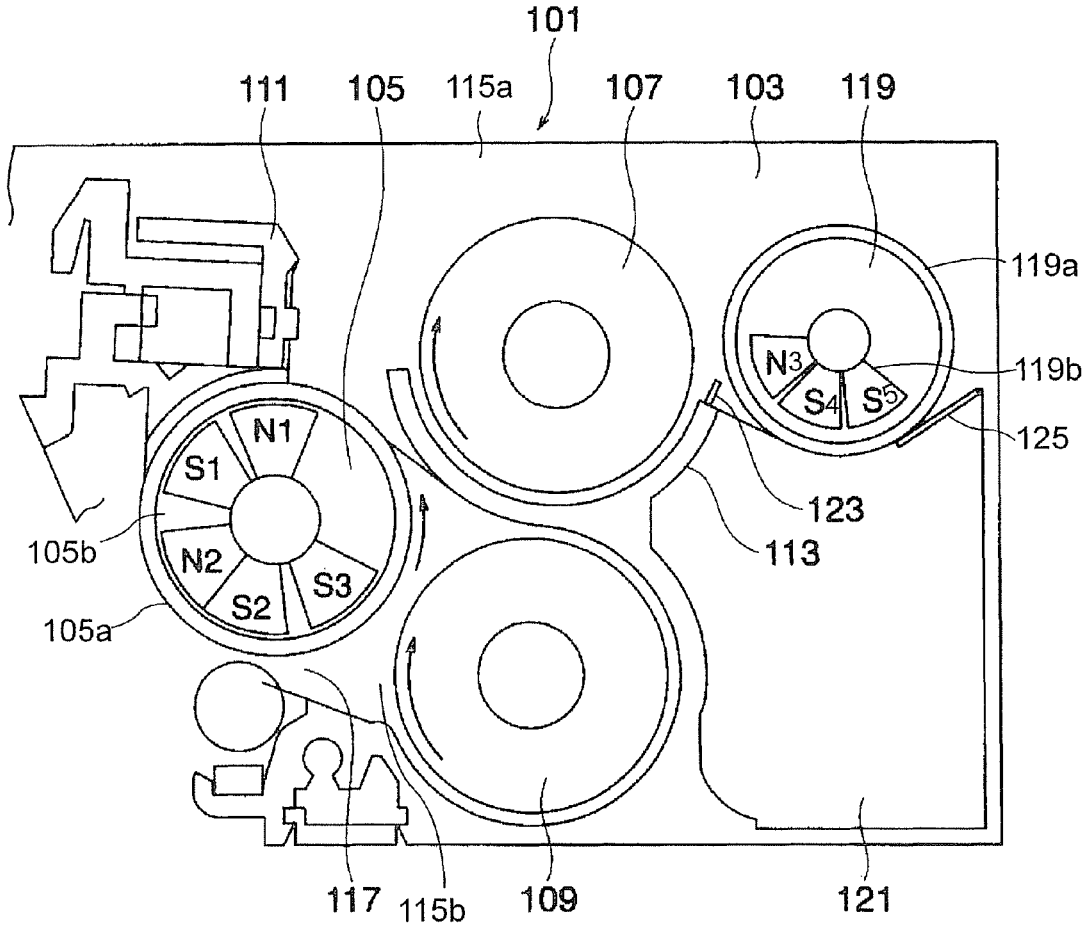
FIG. 1 is an internal block diagram showing the developing device relating to the first embodiment of the present invention.

Next, each of developing devices 101 installed in the respective process cartridges 201Y, 201M, 201C and 201K will be explained in detail by referring to FIGS. 1 and 2.

The developing device 101 has a developer container 103. In the developer container 103, opposite to the photoreceptor drum 203, a developing roller 105 which is a cylindrical rotator is installed. The developer container 103 is internally partitioned by a divider 113 so as to form an upper chamber 115*a* and a lower chamber 115*b*. In the upper chamber 115*a*, an upper conveying auger 107 is installed and in the lower chamber 115*b*, a lower conveying auger 109 is installed. In the upper chamber 115*a* and lower chamber 115*b*, a two-component developer composed of non-magnetic toner and a magnetic carrier is stored.

Furthermore, in the developer container 103, a doctor blade 111 for forming a toner layer with a fixed thickness on the developing roller 105 is installed.

The developing roller 105 is composed of a metallic cylindrical sleeve 105*a* driven to rotate and a plurality of magnets 105*b* fixed and arranged in the sleeve 105*a*. The magnetic permeability of the magnets 105*b* in the developing roller 105 is, for example, 800 G.

In the developer container 103, an exhaust roller 119 which is a developer collection device is installed at the position opposite to the upper conveying auger 107. The exhaust roller 119, similarly to the developing roller 105, is composed of a metallic cylindrical sleeve 119*a* driven to rotate and a plurality of magnets 119*b* fixed and arranged in the sleeve 119*a*. On the divider 113, on the side where the exhaust roller 119 is installed, a doctor blade 123 for forming a developer layer with a fixed thickness on the exhaust roller 119 is installed.

Under the exhaust roller 119 (on the side where the lower chamber 115*b* is installed), an exhausting developer storage case 121 as a collected developer container for storing an exhausting developer collected by the exhaust roller 119 is installed. On the upper part of the exhausting developer storage case 121, an exhaust blade 125 for rubbing off a developer remaining on the exhaust roller 119 is installed. The magnetic permeability of the magnets in the exhaust roller 119 is lower than the magnetic permeability of the magnets in the developing roller 105 such as 200 G. Here, in this embodiment, the length of the exhaust roller 119 is set to the same as that of the upper conveying auger 107.

Figure 2:
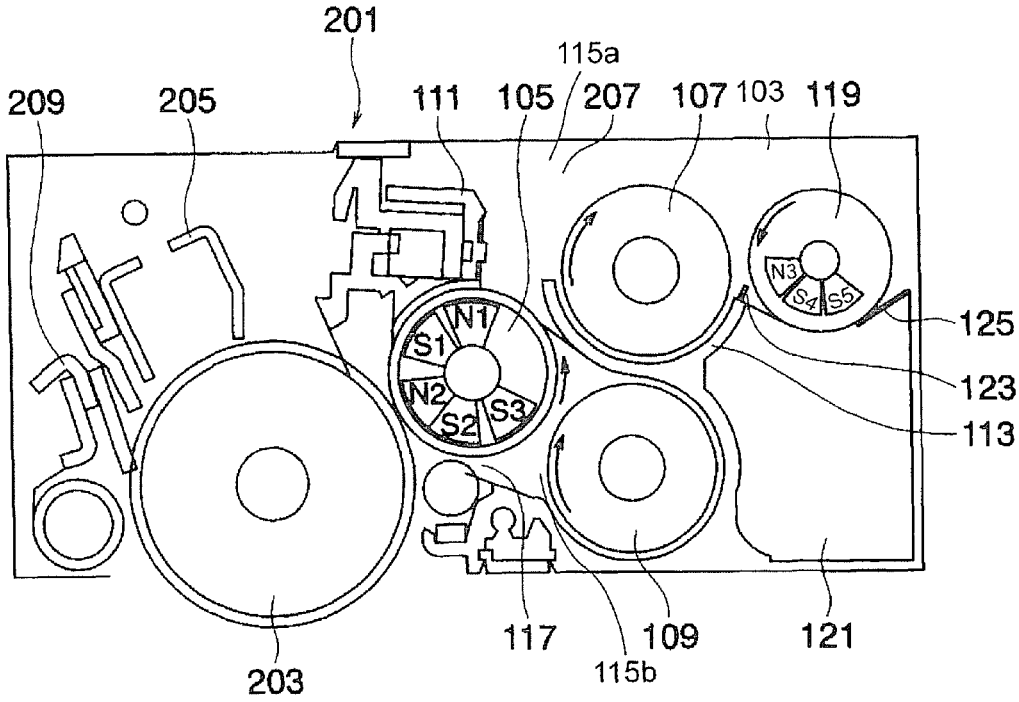
FIG. 2 is an internal block diagram showing the process cartridge relating to the first embodiment of the present invention.
Figure 5:
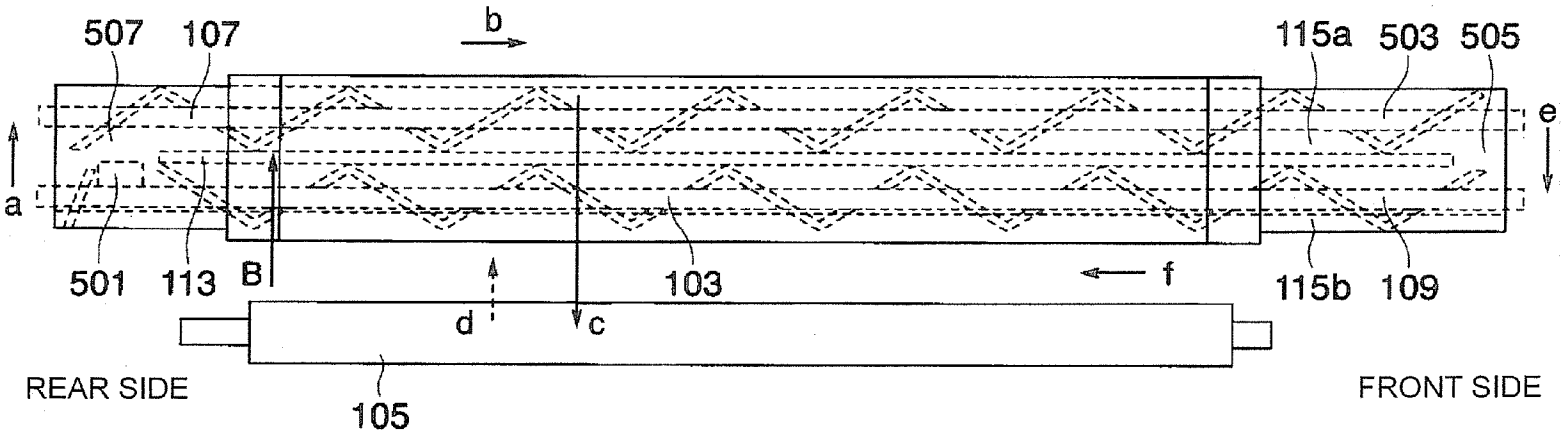
FIG. 5 is a drawing of the inside of the developing device relating to the first embodiment of the present invention which is viewed from the side of the photoreceptor drum.

FIG. 5 is a drawing of the developing device 101 shown in FIG. 2 which is viewed from the side of the photoreceptor drum 203. FIG. 5 shows the status that the developing roller 105 is removed. The actual developing roller 105 is arranged at the position indicated by the arrow B.

Figure 6:
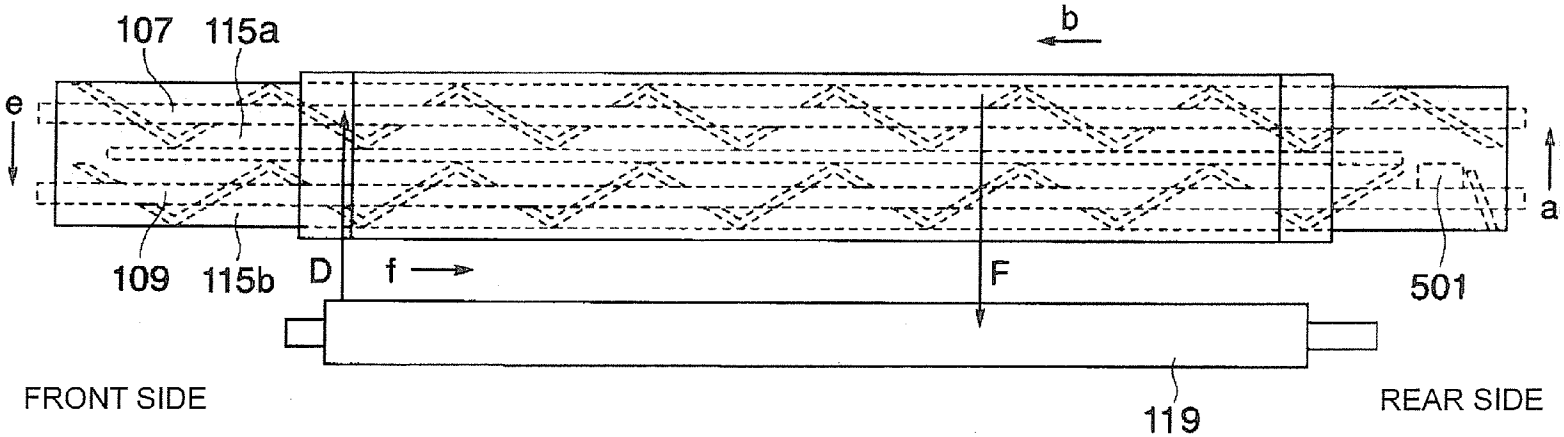
FIG. 6 is a drawing of the inside of the developing device relating to the first embodiment of the present invention which is viewed from the side of the exhaust sleeve.

FIG. 6 is a drawing of the developing device 101 shown in FIG. 2 which is viewed from the side of the exhaust roller 119. FIG. 6 shows the status that the exhaust roller 119 is removed. The actual exhaust roller 119 is arranged at the position indicated by the arrow D.

When the developing device 101 is mounted in the color image forming apparatus 301, the front side of the color image forming apparatus 310 is referred to as the F side and the rear side thereof is referred to as the R side.

At both ends of the divider 113 for partitioning the developer container 103 into the upper chamber 115*a* and lower chamber 115*b*, a first opening 505 and a second opening 507 are installed. The first opening 505 is installed at the end on the F side so as to let a developer conveyed by the upper conveying auger 107 pass through the lower chamber 115*b*. The second opening 507 is installed at the end on the R side so as to let a developer conveyed by the lower conveying auger 109 pass through the upper chamber 115*a*.

Furthermore, in the upper chamber 115*a*, a developer replenishing port 503 through which a developer is supplied by a toner cartridge 701, which will be described later, is installed between the end on the F side of the developing roller 105 and the first opening 505.

Figure 4:
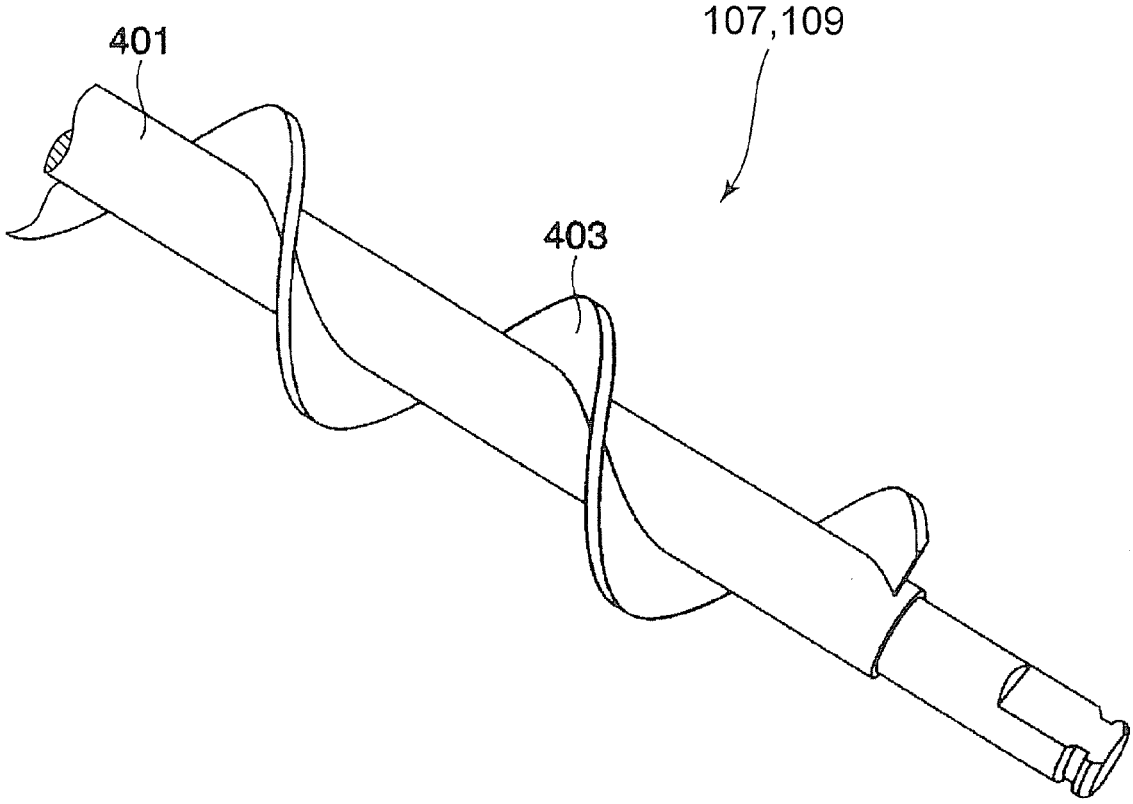
FIG. 4 is an illustration for the conveying auger used in the developing device relating to the first embodiment of the present invention.

Next, by referring to FIGS. 4 and 5, the upper conveying auger 107 and lower conveying auger 109 will be explained.

The upper conveying auger 107 and lower conveying auger 109 are structured so that a window spline 403 is wound spirally round a spindle 401. The diameter of the window spline 403 is, for example, 18 mm and the spiral pitch is, for example, 27 mm. Particularly in the lower conveying auger 109, a return blade 501 for supplying upward the developer at the end on the R side is installed.

If the upper conveying auger 107 is rotated in the arrow direction shown in FIG. 2, the developer in the upper chamber 115*a* is stirred ad conveyed by the upper conveying auger 107. If the lower conveying auger 109 is rotated in the arrow direction shown in FIG. 2, the developer in the lower chamber 115*b* is stirred ad conveyed by the lower conveying auger 109. Here, the developer in the developing device 101 flows in the directions indicated by the arrows a, b, e and f.

Figure 7:
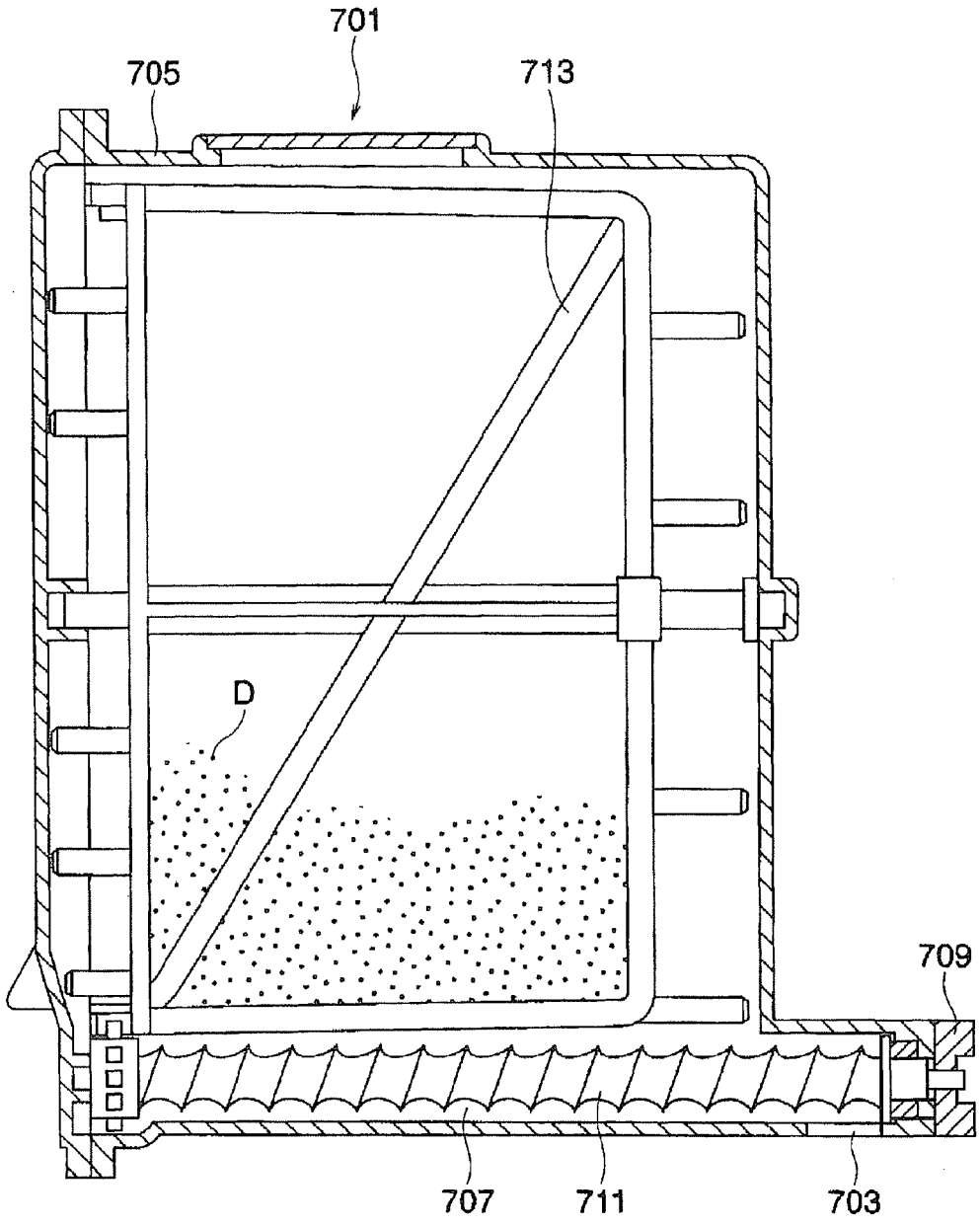
FIG. 7 is an internal block diagram showing the toner cartridge for supplying a developer to the developing device relating to the first embodiment of the present invention.

Next, the entire constitution of the toner cartridge 701 for supplying a developer to the developing device 101 will be explained by referring to FIGS. 7 to 10. As shown in FIG. 7, the toner cartridge 701 is composed of a cartridge main body 705, a developer supply groove 707, a driven coupling 709 and a developer conveying auger 711. The cartridge main body 705 stores a developer D and has a developer supply port 703 interlocking with the developer supply port 503 of the developer device 101. The developer supply groove 707 is formed on the bottom of the cartridge main body 705. The driven coupling 709 is installed at the end of the developer supply groove 707 and receives drive force. The developer conveying auger 711 is installed in the developer supply groove 707 and receives the drive force from the driven coupling 709, thereby rotates. By the rotation of the developer conveying auger 711, the developer D is conveyed to the developer supply port 703.

Furthermore, a developer stirring paddle 713 for rotating in link motion with the rotation of the developer conveying auger 711, thereby stirring the developer D in the cartridge main body 705 and leading the developer D to the developer supply groove 707 is installed.

Figure 8:
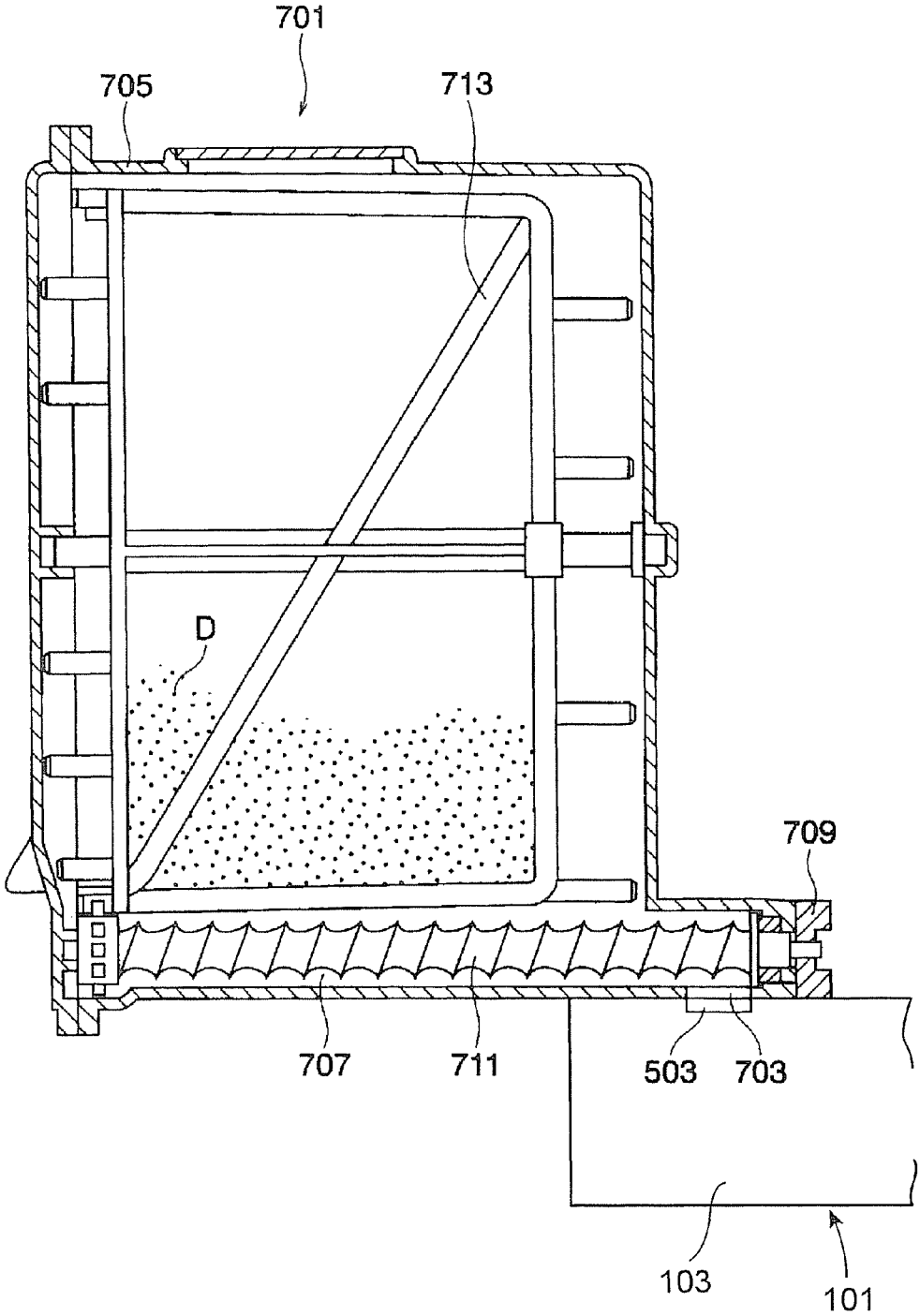
FIG. 8 is a drawing showing the toner cartridge mounted in the developing device relating to the first embodiment of the present invention.
Figure 9:
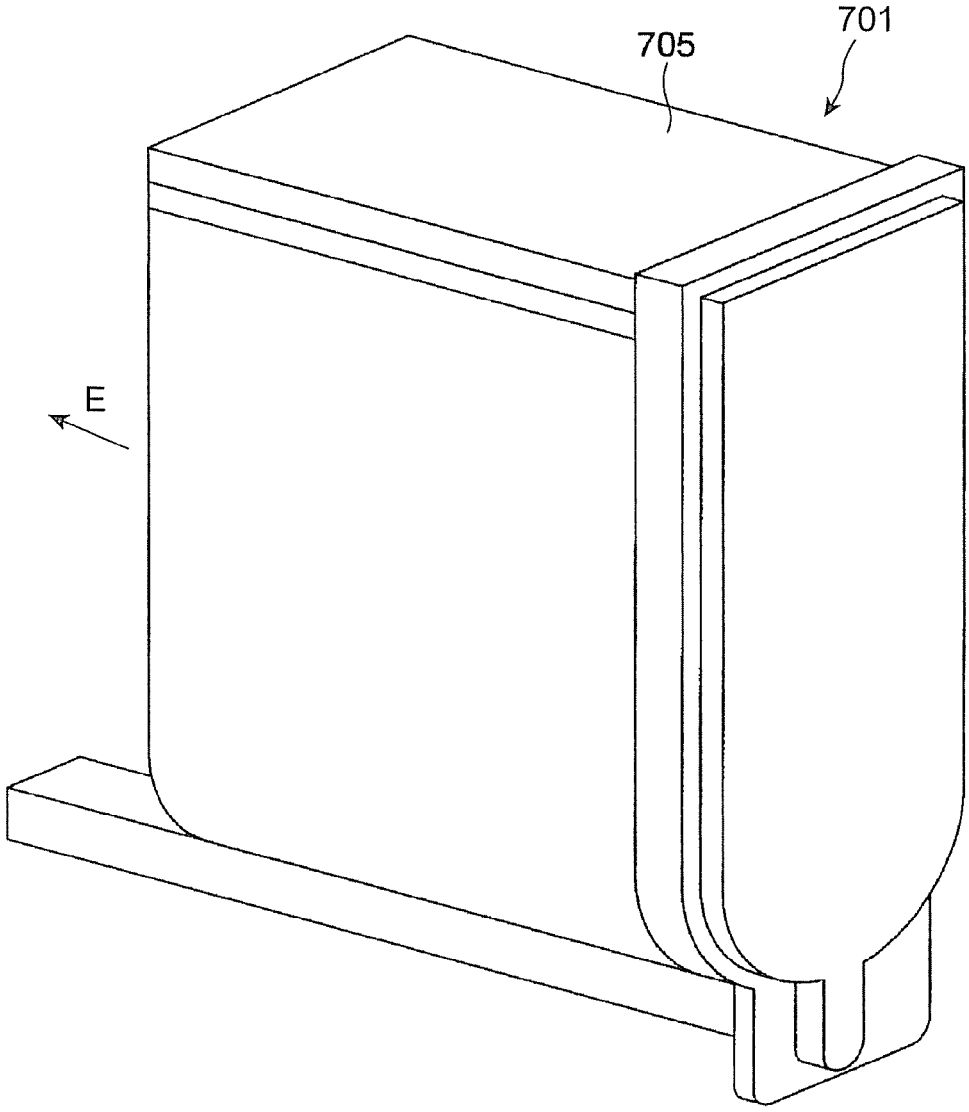
FIG. 9 is a schematic view of the toner cartridge.

The toner cartridge 701 is inserted into the color image forming apparatus 301 in the direction of the arrow E shown in FIG. 9 and as shown in FIG. 8, is mounted on the upper part of the developer container 103 of the developing device 101. At this time, the toner cartridge 701 is mounted at the position where the developer replenishing port 503 of the developer container 103 and the developer supply port 703 of the toner cartridge 701 are fit to each other.

Figure 10:
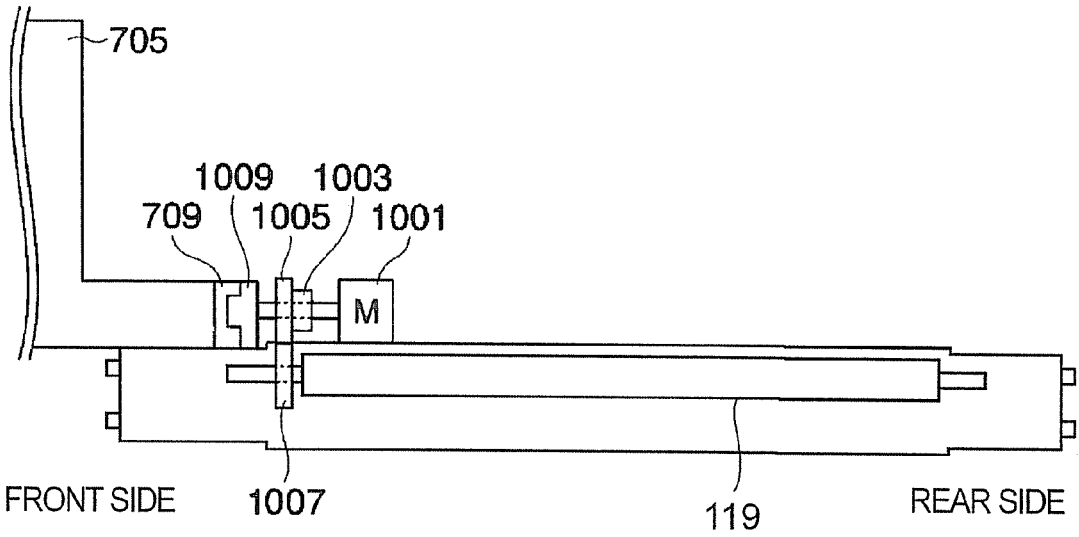
FIG. 10 is a schematic view of the interlocking mechanism of the toner cartridge and exhaust sleeve which is viewed from the exhaust sleeve side.

As shown in FIG. 10, the color image forming apparatus 310 is equipped with a drive motor 1001 which is a drive device. At the end of the drive shaft of the drive motor 1001 on the F side, a drive coupling 1009 is installed. If the toner cartridge 701 is mounted in the color image forming apparatus 301, the driven coupling 709 of the toner cartridge 701 is connected to the drive coupling 1009 and receives drive force from the drive motor 1001.

Figure 11:
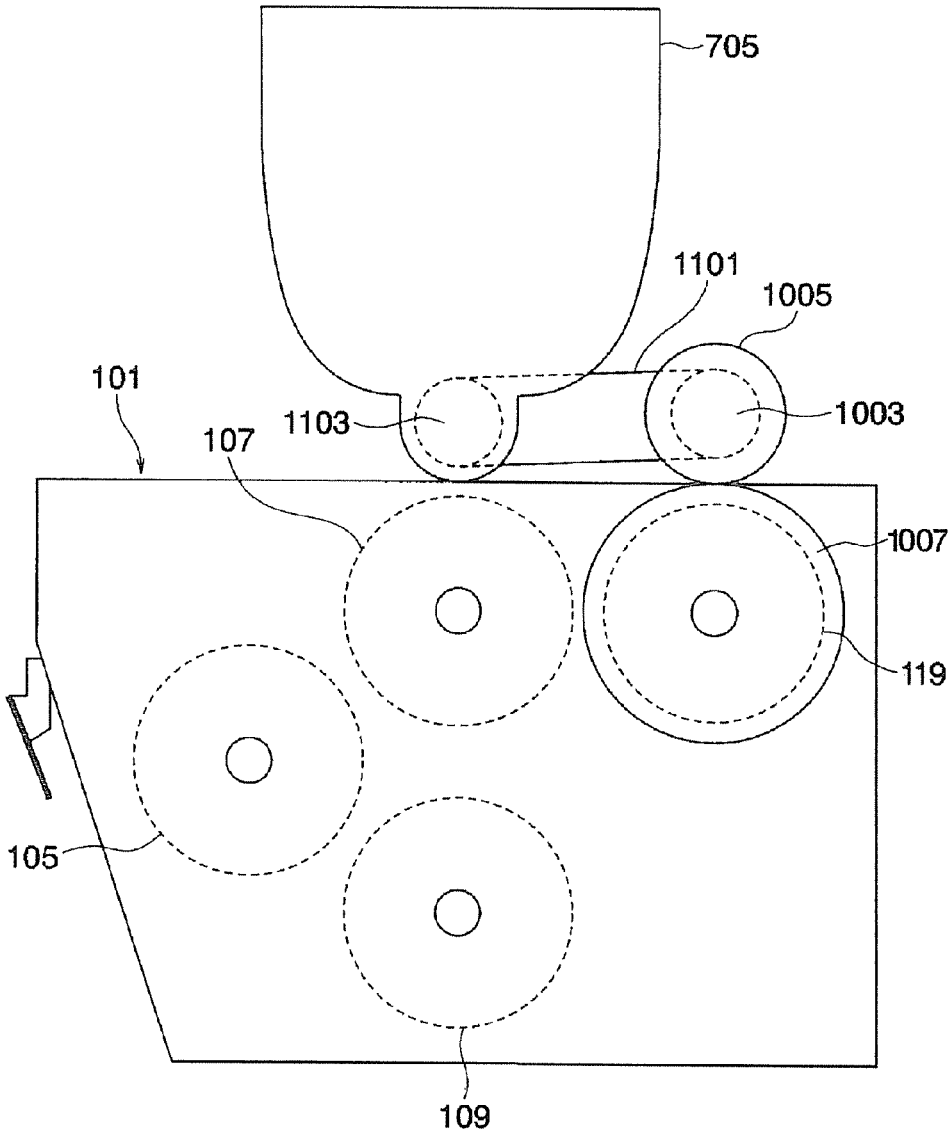
FIG. 11 is a schematic view of the interlocking mechanism of the toner cartridge and exhaust sleeve which is viewed from the front side.

Next, the interlocking mechanism of the developer conveying auger 711 of the toner cartridge 701 and the exhaust roller 119 will be explained by referring to FIGS. 10 to 12.

Figure 12:
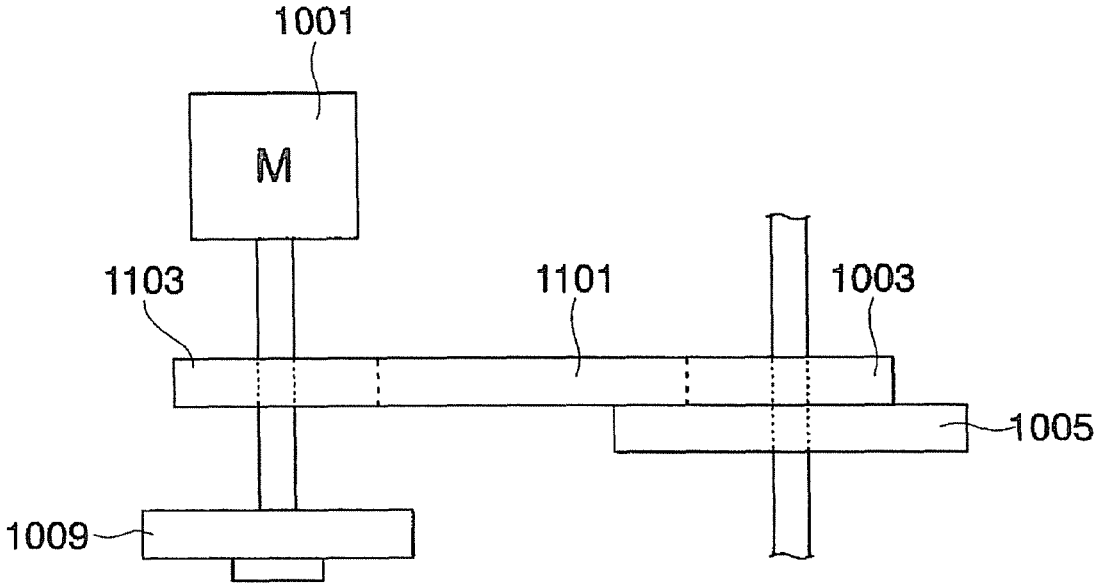
FIG. 12 is a schematic view of the interlocking mechanism of the toner cartridge and exhaust sleeve which is viewed from the toner cartridge.

As shown in FIG. 12, at the end of the drive shaft of the drive motor 1001, the drive coupling 1009 is installed. Between the drive motor 1001 and the drive coupling 1009, a drive pulley 1103 is installed. In the color image forming apparatus 301, a driven pulley 1003 is installed and between the drive pulley 1103 and the driven pulley 1003, a timing pulley 1101 is stretched.

On the rotary shaft of the driven pulley 1003, a first gear 1005 for following the rotation of the driven pulley 1003 is installed. The driven pulley 1103 and first gear 1005 are installed in the color image forming apparatus 301.

On the other hand, on the F side of the rotary shaft of the exhaust roller 119, a second gear 1007 is installed. The exhaust roller 119 is installed at the position where the second gear 1007 is connected to the first gear 1005 installed in the color image forming apparatus 310 by the rotation of the second gear 1007.

By the mechanism aforementioned, the drive force of the drive motor 1001 is transferred to the developer conveying auger 711 of the toner cartridge 701 and the exhaust roller 119 and the developer conveying auger 711 and exhaust roller 119 are interlocked with each other.

Next, the operation of each device during image formation will be explained. During image formation, the photoreceptor drum 203Y is uniformly charged, for example, at −700 V on the surface thereof by the charger. Next, according to an image signal, a laser beam is irradiated to the photoreceptor drum 203Y from the laser beam optical device 315.

The photoreceptor drum 203Y is reduced in the resistance only of the portion where the laser beam is exposed, so that the negative charge of the portion where the laser beam is exposed is deleted, thus an electrostatic latent image is formed.

The formed electrostatic latent image is developed by the developing device 101. Namely, onto the portion of the photoreceptor drum 203Y where the negative charge of the electrostatic latent image is deleted, toner charged negatively is adhered by being given a development bias voltage of −500 V, thus the electrostatic latent image is converted to a developed image.

The sheet P is conveyed between the photoreceptor drum 203Y and the transfer belt 309 and the developed image is transferred onto the sheet P by the transfer device 317Y. The transfer device 317Y, for example, is given a positive charge of 1000 V via the transfer belt 309, thereby attracts and transfers the developed image developed by the toner charged negatively on the photoreceptor drum 203Y onto the sheet P.

Similarly, developed images of magenta, cyan and black are sequentially superimposed and formed on the sheet P by the process cartridges 201M, 201C and 201K, the laser beam optical device 315 and the transfer devices 317Y, 317M, 317C and 317K.

The sheet P is conveyed between the fixing roller 323 heated by the fixing roller lamp 321 and the pressing roller 327 heated by the pressing roller lamp 325. The developed images on the sheet P are heated and pressed by the fixing roller 323 and pressing roller 327, thereby are fixed onto the sheet P.

Hereafter, the sheet P is discharged onto the receiving tray 331 by the pair of exhaust rollers 329. Further, on each of the photoreceptor drums 203Y, 203M, 203C and 203K, there is toner remaining without being transferred. The residual toner is rubbed off by the cleaner, thus the photoreceptor drums 203Y, 203M, 203C and 203K are cleaned.

As shown in FIG. 2, in the developing device 101 during image formation, a part of the developer under conveyance in the upper chamber 115*a* is supplied to the neighborhood of the developing roller 105, is attracted to the developing roller 105 by a magnetic pole N1 installed in the developing roller 105 and is stacked on the developing roller 105, thus a developer layer is formed.

The developer layer formed on the developing roller 105 is conveyed according to rotation of the developing roller 105, is controlled to a fixed height by the doctor blade 111 and is sent between the photoreceptor drum 203 and the developing roller 105 which is a developing section. The developer sent into the developing section is adhered to the photoreceptor 203. The developer after development passes through a developer attraction receiver 117, separates and falls from the developing roller 105 between the magnets S2 and S3 in the developing roller 105, returns to the lower chamber 115*b* and is conveyed again by the lower conveying auger 109.

Next, the developer supply and discharge operation of the present invention will be explained.

If the toner is consumed by image formation, the developer is supplied to the developing device 101 from the toner cartridge 701. During developer supply, by rotation of the drive motor 1001 shown in FIG. 10, the developer conveying auger 711 in the toner cartridge 701 is rotated. If the developer conveying auger 711 rotates, the developer D in the toner cartridge 701 is conveyed toward the developer supply port 703. The developer D conveyed to the developer supply port 703 is supplied from the developer replenishing port 503 installed in the developing device 101 to the developing 101.

As shown in FIG. 2, a part of the developer under conveyance in the upper chamber 115*a* in the developing device 101 is supplied to the neighborhood of the exhaust roller 119 and is attracted to the exhaust roller 119 by a magnetic pole N3 installed in the exhaust roller 119.

The exhaust roller 119 is rotated, thus the developer D is conveyed. The conveyed developer D is controlled to a fixed height by the doctor blade 123 and then separates and falls from the exhaust roller 119 between the magnets S4 and S5 in the exhaust roller 119. The fallen developer D is stored in the exhausting developer storage case 121. The developer D remaining on the exhaust roller 119 without falling is rubbed down in the exhausting developer storage case 121 by the exhaust blade 125.

The exhaust roller 119 of the developing device 101 and the developer conveying auger 711 in the toner cartridge 701 interlock with each other and when a developer is supplied from the toner cartridge 701, the developer is discharged by the exhaust roller 119. Here, the developer discharge quantity by the exhaust roller 119 depends upon the magnetic permeability of the magnets in the exhaust roller 119 and the rotational angle of the exhaust roller 119. Therefore, by changing the magnetic permeability of the magnets in the exhaust roller 119 and the rotational angle of the exhaust roller 119, the developer quantity in the developing device 101 can be kept constant.

If the developer supply and discharge are interlocked with each other in this way, the developer quantity in the developing device 101 can be kept constant.

What is claimed is:

1. An image forming apparatus comprising:

a charger to charge an image carrying member;

an optical device to irradiate a light onto the image carrying member to form an electrostatic latent image;

a developing device to develop the electrostatic latent image on the image carrying member to form a developed image; and a transfer device to transfer the developed image on a sheet, the developing device including:

a developer container to store a developer including toner and a carrier;

a developer supply device to supply the developer to the developer container;

a developer collection device to collect a surplus developer left over due to supply of the developer from the developer supply device to the developer container;

a collected developer container to contain the developer collected by the developer collection device; and a drive device to interlock the developer supply device and the developer collection device, the drive device comprising a drive pulley provided on a drive shaft driving the developer supply device, a driven pulley provided on a drive shaft driving the developer collection device, and a timing belt stretching between the drive pulley and the driven pulley.

2. The apparatus according to claim 1, wherein the developing device includes:

a developing roller comprising a metallic cylindrical sleeve driven to rotate and a plurality of magnets fixed and arranged in the sleeve to supply the developer onto the image carrying member.

3. The apparatus according to claim 2, wherein the developer collection device includes:

an exhaust roller comprising a metallic cylindrical sleeve driven to rotate and a plurality of magnets fixed and arranged in the sleeve to convey the surplus developer to the collected developer container.

4. The apparatus according to claim 3, wherein the exhaust roller rotates upon receipt of drive force from the driver device.

5. The apparatus according to claim 1, wherein the developer supply device includes:

a toner cartridge main body to store the developer;

a developer supply groove formed in an internal bottom of the toner cartridge main body;

a developer supply port installed in the developer supply groove and fit to a developer replenishing port installed in the developer container; and a developer conveying auger installed in the developer supply groove to be rotated by drive force from the driver device and convey the developer in the toner cartridge to the developer supply port.

6. An image forming apparatus comprising:

a charger to charge an image carrying member;

an optical device to irradiate a light onto the image carrying member to form an electrostatic latent image;

a developing device to develop the electrostatic latent image on the image carrying member to form a developed image; and a transfer device to transfer the developed image on a sheet, the developing device including:

a developing roller comprising a metallic cylindrical sleeve driven to rotate and a plurality of magnets fixed and arranged in the sleeve to supply the developer onto the image carrying member;

a developer container to store a developer including toner and a carrier;

a developer supply device to supply the developer to the developer container;

a driver device to drive the developer supply device;

a developer collection device installed in the developer container to interlock with the driver device and collect a surplus developer left over due to supply of the developer from the developer supply device to the developer container, the developer collection device including:

an exhaust roller comprising a metallic cylindrical sleeve driven to rotate and a plurality of magnets fixed and arranged in the sleeve to convey the surplus developer to the collected developer container; and a collected developer container to contain the developer collected by the developer collection device, wherein magnetic permeability of the magnets in the developing roller is larger than magnetic permeability of the magnets in the exhaust roller.

7. The apparatus according to claim 6, wherein the magnetic permeability of the magnets in the developing roller is 800 G and the magnetic permeability of the magnets in the exhaust roller is 200 G.

8. A process cartridge comprising:

an image carrying member whereon an electrostatic latent image is formed;

a developer container to store a developer including toner and a carrier;

a developer supply device to supply the developer to the developer container;

a developer collection device to collect a surplus developer left over due to supply of the developer from the developer supply device to the developer container;

a collected developer container to contain the developer collected by the developer collection device; and a drive device to interlock the developer supply device and the developer collection device, the drive device comprising a drive pulley provided on a drive shaft driving the developer supply device, a driven pulley provided on a drive shaft driving the developer collection device, and a timing belt stretching between the drive pulley and the driven pulley.

9. The cartridge according to claim 8 further comprising:

a developing roller including a metallic cylindrical sleeve driven to rotate and a plurality of magnets fixed and arranged in the sleeve, wherein the developing roller supplies the developer onto the image carrying member.

10. The cartridge according to claim 9, wherein the developer collection device includes:

an exhaust roller including a metallic cylindrical sleeve driven to rotate and a plurality of magnets fixed and arranged in the sleeve to convey the surplus developer to the collected developer container.

11. The cartridge according to claim 10, wherein magnetic permeability of the magnets in the developing roller is larger than magnetic permeability of the magnets in the exhaust roller.

12. The cartridge according to claim 11, wherein the magnetic permeability of the magnets in the developing roller is 800 G and the magnetic permeability of the magnets in the exhaust roller is 200 G.

13. The cartridge according to claim 10, wherein the exhaust roller rotates upon receipt of drive force from the driver device.

14. The cartridge according to claim 8, wherein the developer supply device includes:

a toner cartridge main body to store the developer;

a developer supply groove formed in an internal bottom of the toner cartridge main body;

a developer supply port installed in the developer supply groove and fit to a developer replenishing port installed in the developer container; and a developer conveying auger installed in the developer supply groove to be rotated by drive force from the driver device and convey the developer in the toner cartridge to the developer supply port.

15. A developing device comprising:

a developer container to store a developer including toner and a carrier;

a developer supply device to supply the developer to the developer container;

a developer collection device to collect a surplus developer left over due to supply of the developer from the developer supply device to the developer container;

a collected developer container to contain the developer collected by the developer collection device; and a drive device to interlock the developer supply device and the developer collection device, the drive device comprising a drive pulley provided on a drive shaft driving the developer supply device, a driven pulley provided on a drive shaft driving the developer collection device, and a timing belt stretching between the drive pulley and the driven pulley.

16. The device according to claim 15 further comprising:

a developing roller including a metallic cylindrical sleeve driven to rotate and a plurality of magnets fixed and arranged in the sleeve, wherein the developing roller supplies the developer onto the image carrying member.

17. The device according to claim 16, wherein the developer collection device includes:

an exhaust roller comprising a metallic cylindrical sleeve driven to rotate and a plurality of magnets fixed and arranged in the sleeve to convey the surplus developer to the collected developer container.

18. The device according to claim 17, wherein magnetic permeability of the magnets in the developing roller is larger than magnetic permeability of the magnets in the exhaust roller.

19. The device according to claim 17, wherein the exhaust roller rotates upon receipt of drive force from the driver device.

20. The device according to claim 15, wherein the developer supply device includes:

a toner cartridge main body to store the developer;

a developer supply groove formed in an internal bottom of the toner cartridge main body;

a developer supply port installed in the developer supply groove and fit to a developer replenishing port installed in the developer container; and a developer conveying auger installed in the developer supply groove to be rotated by drive force from the driver device and convey the developer in the toner cartridge to the developer supply port.

* * * * *